US006042856A

United States Patent [19]

Sagan et al.

[11] Patent Number: 6,042,856

[45] Date of Patent: Mar. 28, 2000

[54] SHRIMP CONTAINER

[75] Inventors: Michael John A. Sagan, Batavia; Mark A. Erickson, McHenry; Christina M. Tranfaglia, Chicago; Thomas J. Hayes, Wauconda; Robert S. Schlaupitz, Wadsworth, all of Ill.

[73] Assignee: Pactiv Corporation, Canandaigua, N.Y.

[21] Appl. No.: 08/984,491

[22] Filed: Dec. 8, 1997

[51] Int. Cl.[7] ..... A22C 17/10

[52] U.S. Cl. ..... 426/87; 426/115; 426/106; 426/129; 426/120; 206/465; 220/575; 220/23.87

[58] Field of Search ..... 426/87, 106, 185, 426/119, 120, 129; 206/541, 564; 220/574, 575, 780, 23.87

[56] References Cited

U.S. PATENT DOCUMENTS

| | | | |
|---|---|---|---|
| D. 218,804 | 9/1970 | Doubleday | D9/220 |
| D. 225,050 | 11/1972 | Cannell | D9/3 |
| D. 328,705 | 8/1992 | Krupa | D9/420 |
| D. 329,198 | 9/1992 | Krupa | D9/423 |
| D. 342,646 | 12/1993 | Sicard et al. | D7/556 |
| D. 344,660 | 3/1994 | Krupa | D7/629 |
| D. 345,912 | 4/1994 | Krupa | D9/429 |
| D. 346,554 | 5/1994 | Krupa | D9/429 |
| D. 359,418 | 6/1995 | Sicard et al. | D7/553 |
| D. 364,090 | 11/1995 | Krupa | D9/429 |
| D. 371,964 | 7/1996 | Krupa | D9/429 |
| D. 373,726 | 9/1996 | Power | D9/429 |
| 1,454,639 | 5/1923 | Haines . | |
| 1,595,356 | 8/1926 | Moseman . | |
| 1,949,285 | 2/1934 | Porter . | |
| 2,174,586 | 10/1939 | Leppke | 65/15 |
| 2,294,657 | 9/1942 | Flanagan | 65/15 |
| 2,789,607 | 4/1957 | Tupper | 220/780 |
| 3,212,907 | 10/1965 | Caprioli | 426/115 |
| 3,261,458 | 7/1966 | Nibecker | 206/47 |
| 3,508,930 | 4/1970 | Bennet et al. | 426/129 |
| 3,671,272 | 6/1972 | Mixon | 426/129 |
| 3,938,688 | 2/1976 | Ryan | 220/23.8 |
| 4,055,672 | 10/1977 | Hirsch et al. | 426/129 |

(List continued on next page.)

OTHER PUBLICATIONS

Packaging Lable for Northern King Cooked Shrimp Ring.

Ultra Pack Catalogue description for Sample No 70–64ST, Shrimp Tray (sample not enclosed), 1994.

Ivex brochure for Shrimp Servers Combo–Packs, Ivex Customer Service contacted and gave start date for product sales as 1994. (sample not enclosed) 1994.

Analysis of Visual Quality Attributes of White Shrimp by Machine Vision, Diego Luzuriaga, Murat Balaban, Sencer Yeralan, vol. 62, No. 1, 1977 (Abstract).

"Advantages of Octa View," by De Ster Corporation, Atlanta, GA.

"Mini Trays with Shrimp in Mind: Combo Packs," by James L. Villa, Inc. Oldsmar, FL.

"Sea Food Better with Octa View™," by De Ster Corporation, Atlanta, GA.

"Sho–Bowls™ Deli Containers," by UltraFresh™ Catalog, p. 18 (May 1995).

"Shrimp Servers," by Ivex Packaging Corporation, Lincolnshire, IL.

"Welcome to De Ster's World of Octa View™," by De Ster Corporation, Atlanta, GA.

*Primary Examiner*—Nina Bhat
*Assistant Examiner*—Sherry A. Dauerman
*Attorney, Agent, or Firm*—Arnold White & Durkee

[57] ABSTRACT

A base for displaying and holding shrimp comprises a well having a bottom wall, and a first side wall. The bottom wall has a surface for holding a sauce receptacle. The first side wall encompassing and extends upwardly and outwardly from the bottom wall. The first side wall has a plurality of slots each for displaying and holding an individual shrimp. Each slot has a section extending outwardly as viewed from an interior of the well. The base also includes a peripheral trough having a second side wall, a trough bottom wall and an outer wall. The second side wall encompasses and extends downwardly from an upper portion of said first side wall.

21 Claims, 6 Drawing Sheets

U.S. PATENT DOCUMENTS

| | | | |
|---|---|---|---|
| 4,225,052 | 9/1980 | Tector et al. | 220/22 |
| 4,314,650 | 2/1982 | Cillario | 220/23.83 |
| 4,351,164 | 9/1982 | Christiani | 62/315 |
| 4,874,083 | 10/1989 | Antoni et al. | 206/564 |
| 4,899,881 | 2/1990 | Girard et al. | 206/457 |
| 4,964,507 | 10/1990 | Chen | 206/557 |
| 5,005,703 | 4/1991 | Bodker | 206/563 |
| 5,209,348 | 5/1993 | Schafer, III | 206/222 |
| 5,346,070 | 9/1994 | McSpadden | 206/561 |
| 5,353,952 | 10/1994 | Donche | 220/575 |
| 5,377,855 | 1/1995 | Cook, Jr. et al. | 220/423 |
| 5,413,801 | 5/1995 | McIlwain | 426/420 |
| 5,441,164 | 8/1995 | Beck et al. | 220/575 |
| 5,529,794 | 6/1996 | Fultz | 426/115 |
| 5,593,062 | 1/1997 | Martin | 220/574 |
| 5,607,709 | 3/1997 | Fritz et al. | 426/106 |

SHRIMP CONTAINER

FIELD OF THE INVENTION

The present invention relates generally to food packaging containers and, more particularly, relates to a leak-resistant shrimp container which facilitates counting of shrimp.

BACKGROUND OF THE INVENTION

The use of inexpensive plastic or metallic food packaging containers has become popular for dispensing and serving various food products. Food packaging containers for serving shrimp have been used, for example, by seafood companies, grocery stores, food packers, catering services and the like. These shrimp containers typically comprise a cover or lid and a base. The base of the shrimp container typically contains a well with an inner area for holding the shrimp sauce and a smooth outer wall for placing the shrimp. The shrimp in these containers may be sold by number (e.g., 30 or 40 shrimp) or by weight.

However, if the customer desires to purchase the shrimp by number, a problem may arise in that an individual employee must accurately count the number of shrimp. This problem is especially prevalent around busy times of the year, such as holidays, where companies must hire additional employees to fill the orders. These additional untrained employees are prone to miscounting the shrimp which can lead either to customer dissatisfaction or a loss of profits to the companies. Alternatively, the counting of the shrimp might be performed a second or third time resulting in a decreased packing efficiency.

Another drawback associated with existing shrimp containers is the leaking of liquid, such as shrimp purge, from the containers. This liquid can leak, for example, between the cover and the base onto a hand or arm of a customer. Moreover, this can lead to extreme customer dissatisfaction if the shrimp purge should flow onto the apparel of a customer. Even if the liquid does not contact a customer, it is not aesthetically pleasing to a customer to observe leaking liquid from a shrimp container. Such a container will most likely have an adverse effect on the sale of the shrimp.

Accordingly, a need exists for a shrimp container which overcomes the above-noted shortcomings associated with existing shrimp containers.

SUMMARY OF THE INVENTION

In one particular embodiment of the present invention, a base for displaying and holding shrimp comprises a well, and a peripheral trough. The well has a bottom wall and a first side wall. The bottom wall has a surface for holding a sauce receptacle. The first side wall encompasses and extends upwardly and outwardly from the bottom wall. The first side wall has a plurality of slots each for displaying and holding an individual shrimp. Each slot has a section that extends outwardly as viewed from an interior of the well. The peripheral trough includes a second side wall and an outer wall. The second side wall encompasses and extends downwardly from an upper portion of the first side wall.

In preparing the shrimp prior to sale to a customer, the base is preferably enclosed by a removable cover. The cover has a closure mechanism which releasably engages with a closure mechanism of the base. Each of the closure mechanisms have a generally horizontal ledge extending outwardly from the peripheral trough. The cooperation of the closure mechanisms inhibit liquids, such as, shrimp purge from leaving the container.

BRIEF DESCRIPTION OF THE DRAWINGS

Other objects and advantages of the invention will become apparent upon reading the following detailed description and upon reference to the drawings in which.

Figure 1:
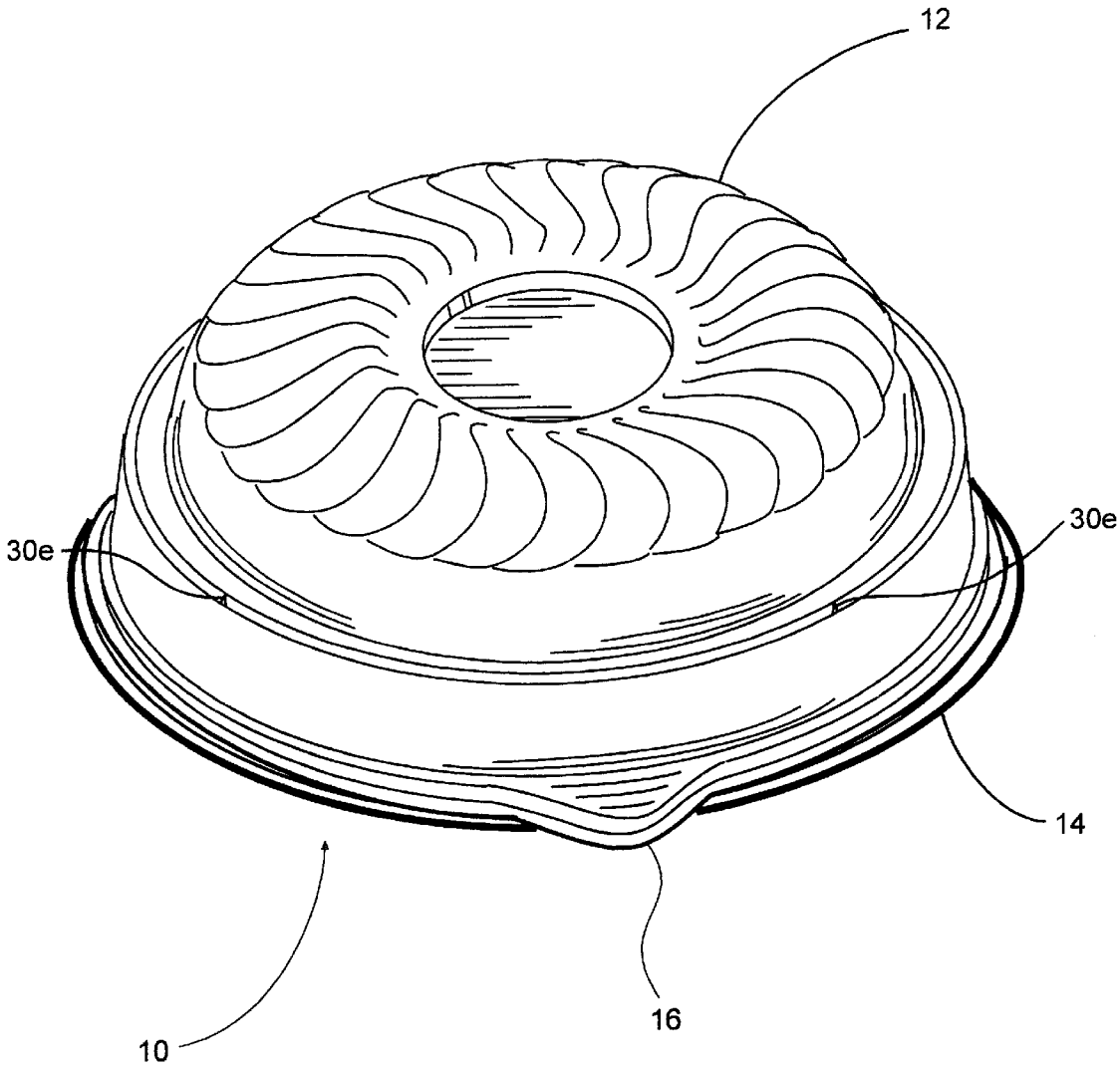
FIG. 1 is a perspective view of an assembled shrimp container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIG. 1 depicts an improved container 10 for holding and transporting a plurality of shrimp. The container 10 is comprised of a cover or lid 12 and a base 14. The cover 12 is adapted to releasably engage the base 14. To assist a user in disengaging the cover 12 and the base 14, the cover may include a tab 16 as depicted in FIG. 1. While the container 10 is depicted in FIG. 1 as being of a generally circular configuration, the invention herein disclosed is not intended to be limited thereto but may take various other geometric shapes, such as oval and polygonal shapes.

Figure 2:
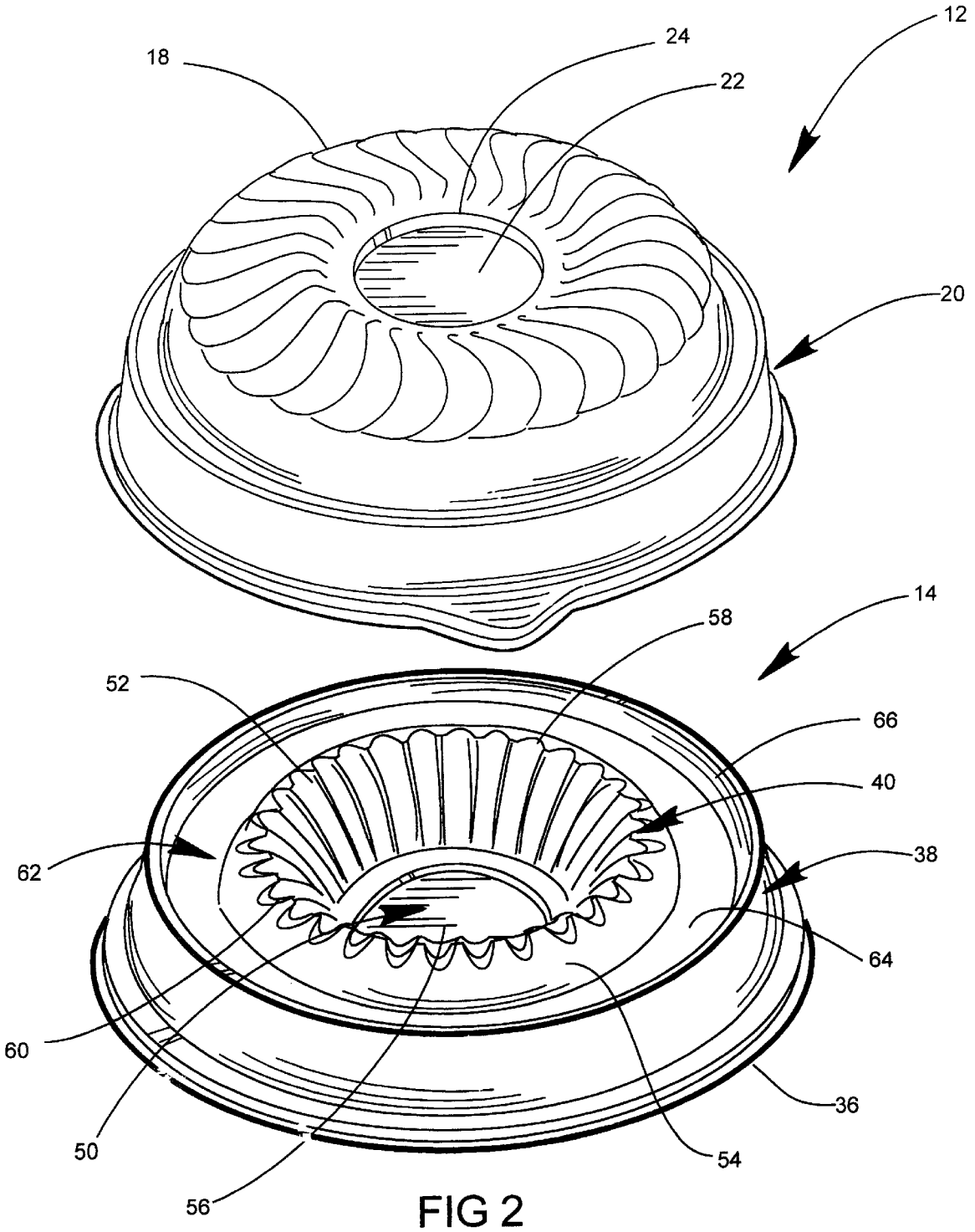
FIG. 2 is an exploded perspective view of the shrimp container, which includes a cover and a base, according to one embodiment of the present invention.

Referring to FIG. 2, the cover 12 includes a top wall 18 and a cover side wall 20. The side wall 20 encompasses the top wall 18 and extends downward and slightly outward therefrom. The top wall 18 is elevated with respect to the cooperating base 14 in order to accommodate a plurality of shrimp and a sauce receptacle (see FIG. 4). The top wall 18 may include a central portion 22 and a peripheral shoulder 24. The central portion 22 is recessed relative to the peripheral shoulder 24 to cooperate with the base (akin to base 14) of another food packaging container stacked atop the container 10. While the central portion 22 is illustrated in FIG. 2 as being of a circular construction, other shapes are contemplated such as oval and polygonal shapes. In order to enhance the aesthetic appearance and marketing appeal of the cover 12, the top wall 18 may be intaglioed with an attractive design.

Figure 3B:
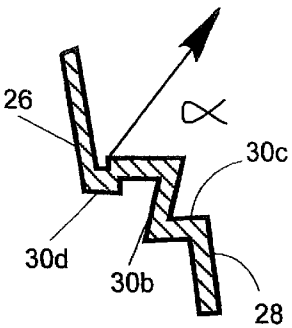
FIG. 3*b* is a cross-sectional view of the closure mechanism of the cover taken through the center thereof.
Figure 3C:
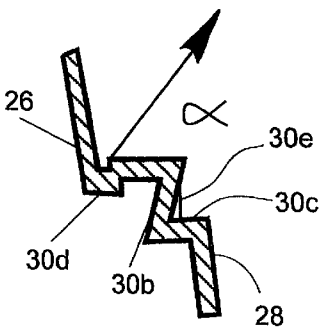
FIG. 3*c* is a cross-sectional view of the closure mechanism of a second embodiment of the present invention.
Figure 3A:
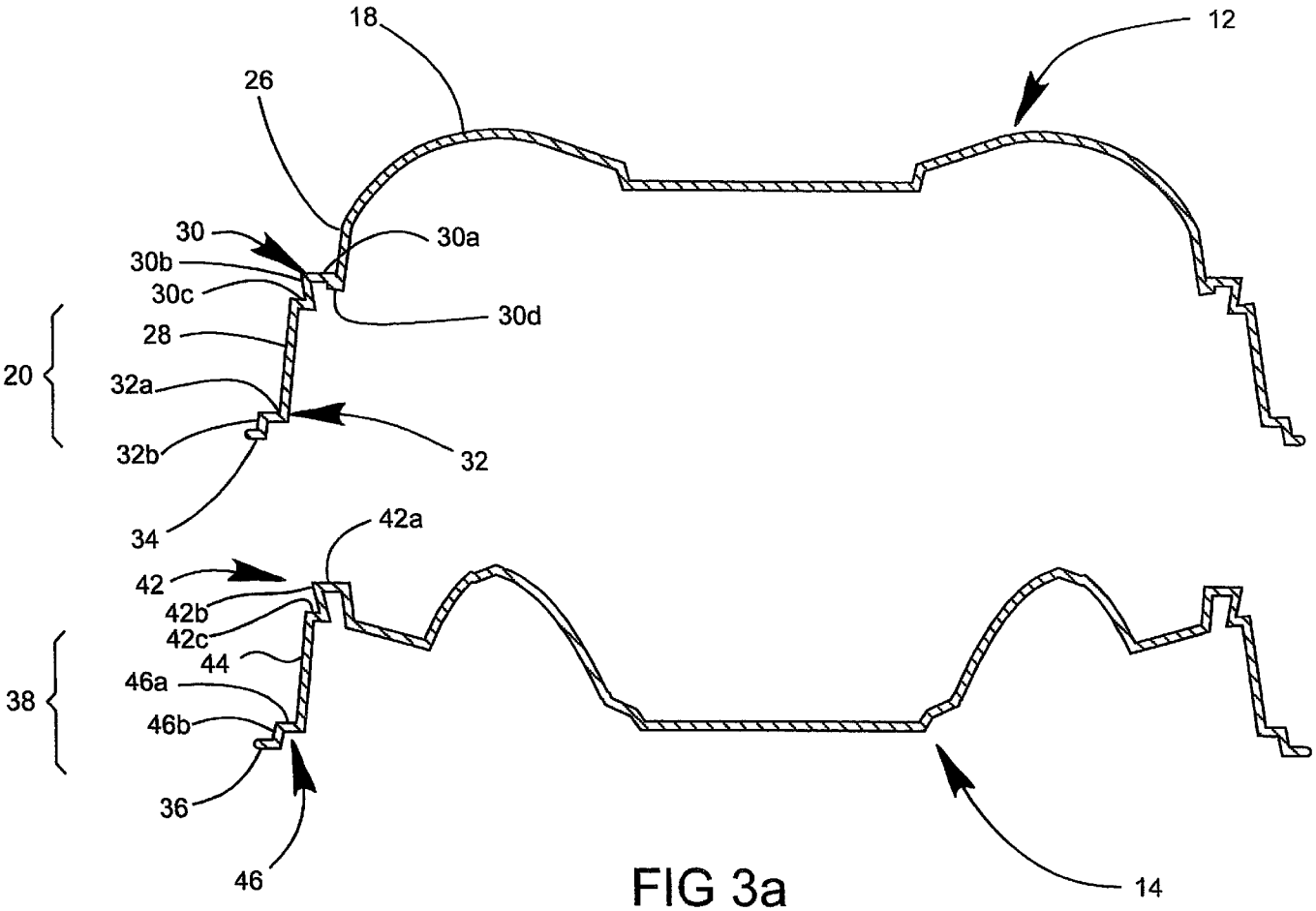
FIG. 3*a* is an exploded cross-sectional view of the shrimp container taken though a center thereof.

Referring to FIG. 3*a*, the cover side wall 20 is comprised of a first section 26, a generally vertical second section 28, a circumferential cover closure mechanism 30, a circumferential stiffener shoulder 32 and a peripheral flange 34. The first section 26 encompasses the top wall 18 and extends downwardly and outwardly therefrom. The cover closure mechanism 30 cooperates or engages with a counterpart on the base 14 in order to inhibit liquids, such as shrimp purge, from escaping the container 10. Shrimp purge can include moisture in the package from the residual water used in thawing the shrimp, liquid coming directly from the shrimp, and condensation within the container 10.

The cover closure mechanism 30 includes a generally horizontal first ledge 30*a*, a generally vertical wall 30*b*, a generally horizontal second ledge 30*c* and a drip first ledge 30*d*. The ledge 30*a* extends outwardly from the first section 26 and encompasses the first section 26. The drip ledge 30*d* extends downwardly from the first section 26 so as to extend below a horizontal plane of first ledge 30*a*. The drip ledge 30*d* assists in preventing shrimp purge from reaching the first ledge 30*a* especially when the container 10 is in a non-tilted position. The wall 30*b* extends downwardly and very slightly inwardly from the first ledge 30*a* and encompasses the first ledge 30*a*. The second ledge 30*c* extends outwardly from the wall 30*b* and encompasses the wall 30*b*. It is contemplated that cover closure mechanism 30 may include radiused/curved components instead of substantially planar components.

The term "generally horizontal ledge" as used defined herein is a ledge extending at an angle within about 15 degrees in either direction from a horizontal plane. It is contemplated that the first ledge 30*a* may also extend outwardly at an angle greater than that defined as being "generally horizontal" (see FIG. 3*b*). For example, first ledge 30*a* may extend upwardly and outwardly from first section 26 at an angle from about 15 degrees to about 85 degrees (depicted as angle $\alpha$ in FIG. 3*b*), and more preferably from about 15 degrees to about 45 degrees as measured from a plane extending perpendicularly from first section 26. When the first ledge 30*a* is angled, it assists in preventing the shrimp purge from escaping the container 10 in a similar manner to that of drip ledge 30*d*.

The second section 28 extends downwardly and outwardly from the cover closure mechanism 30 until reaching the stiffener shoulder 32. The stiffener shoulder 32 enhances the resistance of the container 10 to torsional and bending stresses. The stiffener shoulder 32 cooperates or engages with a counterpart on the base 14. The stiffener shoulder 32 includes a generally horizontal ledge 32*a* and a generally vertical wall 32*b*. The ledge 32*a* extends outwardly from the second section 28 and encompasses the second section 28. The wall 32*b* extends downwardly from the ledge 32*a* and encompasses the ledge 32*a*. The peripheral flange 34 extends outwardly from the wall 32*b*.

Referring back to FIG. 2, the base 14 of the container 10 includes a peripheral flange 36 and a side wall 38 which extends upwardly and slightly inwardly therefrom. The base 14 further includes a well 40 positioned inward of the side wall 38 and a peripheral trough 62. The base 14 is formed to produce a table-ready appearance that is aesthetically pleasing to a customer. Referring back to FIG. 3*a*, the side wall 38 includes a circumferential base closure mechanism 42, a transition portion 44 and a circumferential stiffener shoulder 46. The base closure mechanism 42 includes a generally horizontal first ledge 42*a*, a generally vertical wall 42*b* and a generally horizontal second ledge 42*c*. The first ledge 42*a* extends outwardly as viewed from an interior of the well 40. The wall 42*b* encompasses first ledge 42*a* and extends downwardly and slightly inwardly therefrom. The second ledge 42*c* encompasses the wall 42*b* and extends outwardly therefrom.

To inhibit liquids, such as shrimp purge, from leaving the container 10, the base closure mechanism 42 of the base 14 cooperates with the closure mechanism 30 of the cover 12. Thus, it is also contemplated that first ledge closure mechanism 42*a* may extend outwardly at an angle greater than that defined as being "generally horizontal". The first ledge 42*a* may be angled from about 15 degree to about 85 degrees, and more preferably from about 15 degrees to about 45 degrees to correspond with the first ledge 30*a* of the cover 12. Specifically, elements 42*a–c* of the base closure mechanism 42 releasably engage the respective elements 30*a–c* of the cover closure mechanism 30.

Figure 4:
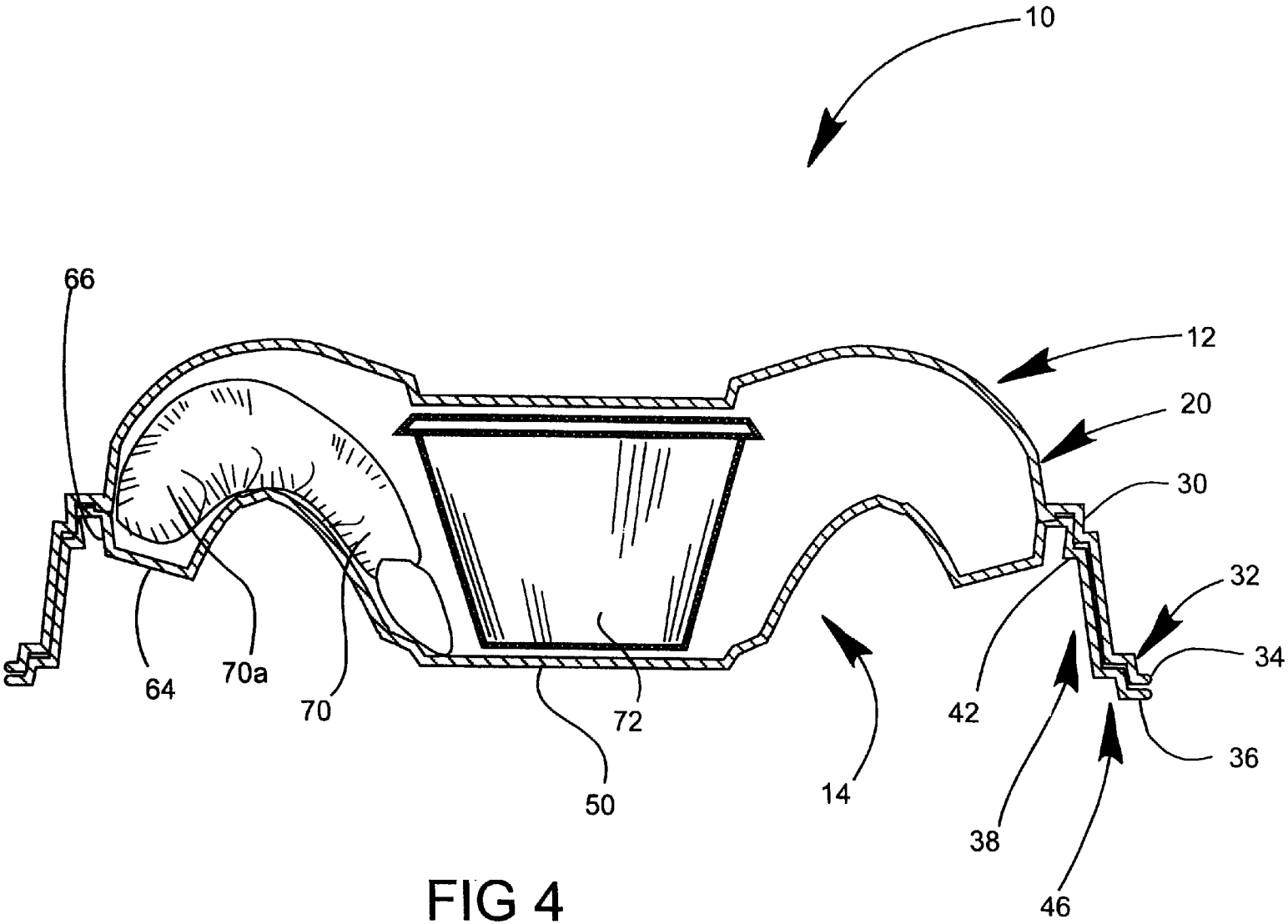
FIG. 4 is a cross-sectional view of the assembled shrimp container taken through the center thereof.

FIG. 4 depicts the cooperation between the cover side wall 20 and the base side wall 38 including the closure mechanisms. The cover and base closure mechanisms 30 and 42, respectively are preferably designed so that a shrimp 70 stays inwardly therefrom to assist in inhibiting the liquids from leaving the container 10. The cover and base closure mechanisms 30 and 42, respectively cooperate to form a tortuous path for a liquid when engaged. In order for a liquid to escape through the cover and base closure mechanisms 30 and 42, respectively a liquid would first need to flow upwardly in a vertical direction, then horizontally, then flow downwardly in a vertical direction and lastly horizontally. Alternatively, in an embodiment without drip ledge 30*d* and with base ledge 30*a* angled upwardly, the liquid would first need to flow upwardly and outwardly, then flow downwardly in a vertical direction and lastly horizontally. These tortuous paths reduce the possibility of liquid leaking from the container 10, especially considering the liquid must first flow upwardly.

Referring back to FIG. 3*a*, the transition portion 44 of the base side wall 38 extends downwardly and outwardly from the base closure mechanism 42. The portion 44 engages the second section 28 of the cover 12. The portion 44 also encompasses the base closure mechanism 42. The stiffener shoulder 46 includes a generally horizontal ledge 46*a* and a generally vertical wall 46*b*. The ledge 46*a* encompasses the portion 44 and extends outwardly therefrom. The wall 46*b* encompasses the ledge 46*a* and extends downwardly and slightly outwardly therefrom until reaching the flange 36.

As best shown in the assembled container 10 in FIG. 4, the stiffener shoulder 46 cooperates or engages with the stiffener shoulder 32 of the cover 12. Specifically, elements 46*a–b* of the stiffener shoulder 46 are immediately adjacent to respective elements 32*a–b* of the stiffener shoulder 32. The stiffener shoulders 32 and 46 enhance the resistance of the container 10 to torsional and bending stresses. The stiffener shoulders 32 and 46 also assist in inhibiting liquid, such as shrimp purge, from leaving the container 10 should any leak through the cooperating cover and base closure mechanisms 30 and 42, respectively.

To assist in disassembling the assembled container in FIGS. 1 and 4, the flange 34 of the cover 12 preferably does not abut the flange 36 of the base 14. Thus, flange 34 is vertically spaced away from the flange 36. This configuration assists a consumer in disassembling the container 10 because it allows an individual to easily grasp the flange 34 and the flange 36. If the tab 16 is formed in the cover 12, it is preferable to grasp the tab 16 of the cover 12 when disassembling the container 10. Additionally, the vertical spaced flanges 34 and 36 assist a consumer in assembling the container in FIGS. 1 and 4 by allowing the cover 12 to fit better over the base 14. Specifically, the space between the flanges 34 and 36 allows for better placement of the cover 12 onto the base 14 because it reduces the likelihood that the flanges 34 and 36 will first abut on only one side and result in an improperly assembled container 10 (i.e., a container which is partially open).

Referring to FIG. 3*c*, it is contemplated that a plurality of leak-resistant vents 30*e* (a vent 30*e* is shown) may be included to assist in closing the container 10. Specifically, the vent 30*e* releases air when the cover 12 is being placed over the base 14. As depicted in FIG. 3*c*, the vent 30*e* is formed in vertical wall 30*b* at a point slightly below a horizontal plane of first ledge 30*a* and extends downwardly to second ledge 30*c*. It is contemplated that the plurality of vents 30*e* may be of various shapes, including a triangular shape.

Figure 5:
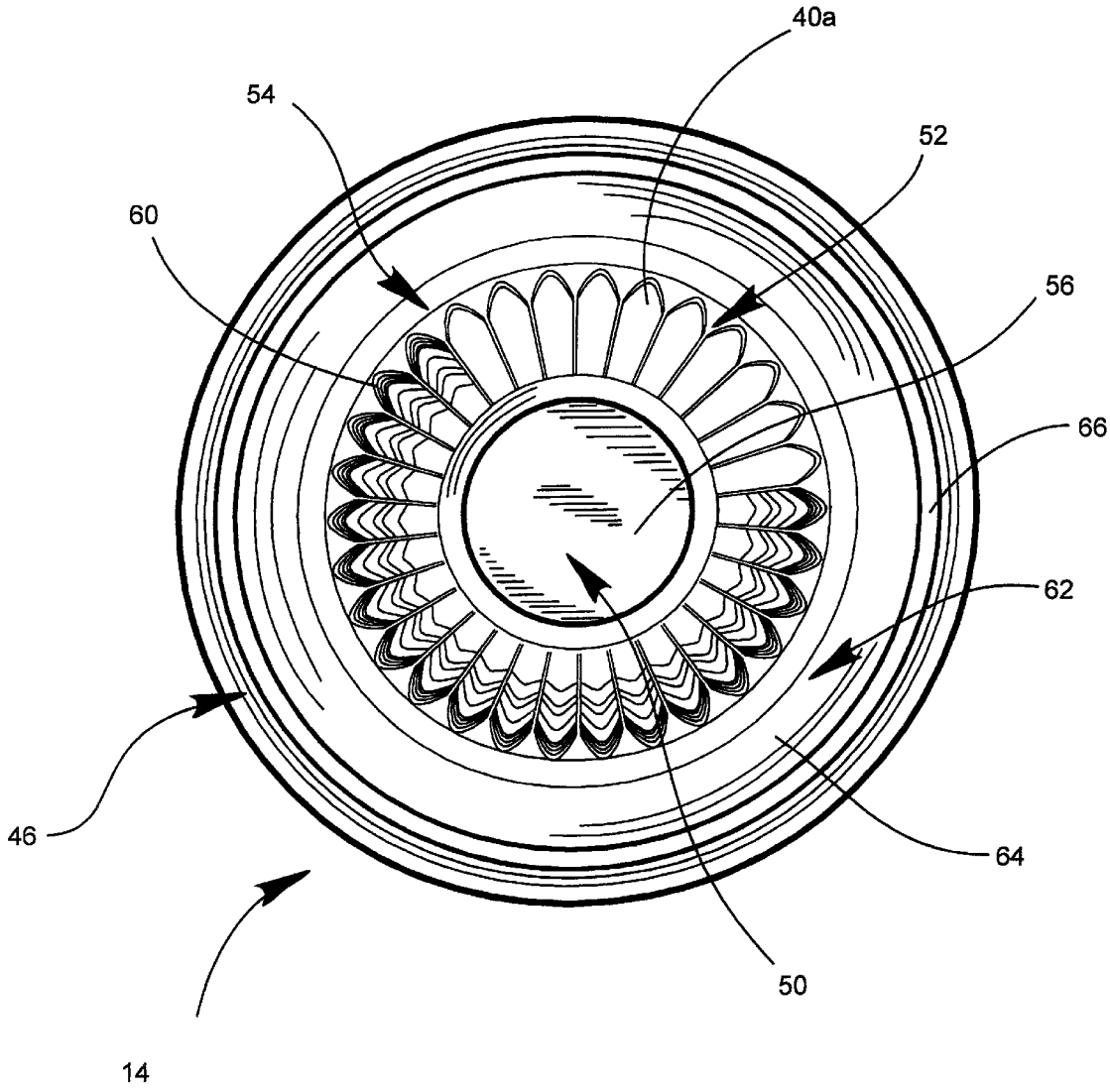
FIG. 5 is a top view of the base of the shrimp container.

Referring back to FIG. 2, the base 14 includes the well 40 located inside of side wall 38. The well 40 as depicted in FIGS. 2 and 5 are of a cylindrical configuration. However, it is contemplated that the well 40 may be formed from many other shapes including, but not limited to, oval and polygonal shapes. The well 40 includes a bottom wall 50, and a base side wall 52. The bottom wall 50 has a recessed central portion 56 for holding a sauce receptacle (see FIG. 4). This sauce receptacle preferably includes sauces which are compatible with shrimp, including, but not limited to, shrimp cocktail sauce and the like.

The base side wall 52 encompasses the bottom wall 50 and extends upwardly and outwardly therefrom. The configuration of the base 14, including the base side wall 52 and the bottom wall 50 with the recessed central portion 56, assist in prominently displaying the shrimp relative to the sauce receptacle. As illustrated in FIG. 4, an installed shrimp 70 is elevated relative to the sauce receptacle 72 to emphasize the shrimp 70 and deemphasize the sauce receptacle 72. The base side wall 52 includes a plurality of slots or indentations 58 for displaying, transporting and holding respective individual shrimps.

Figure 6:
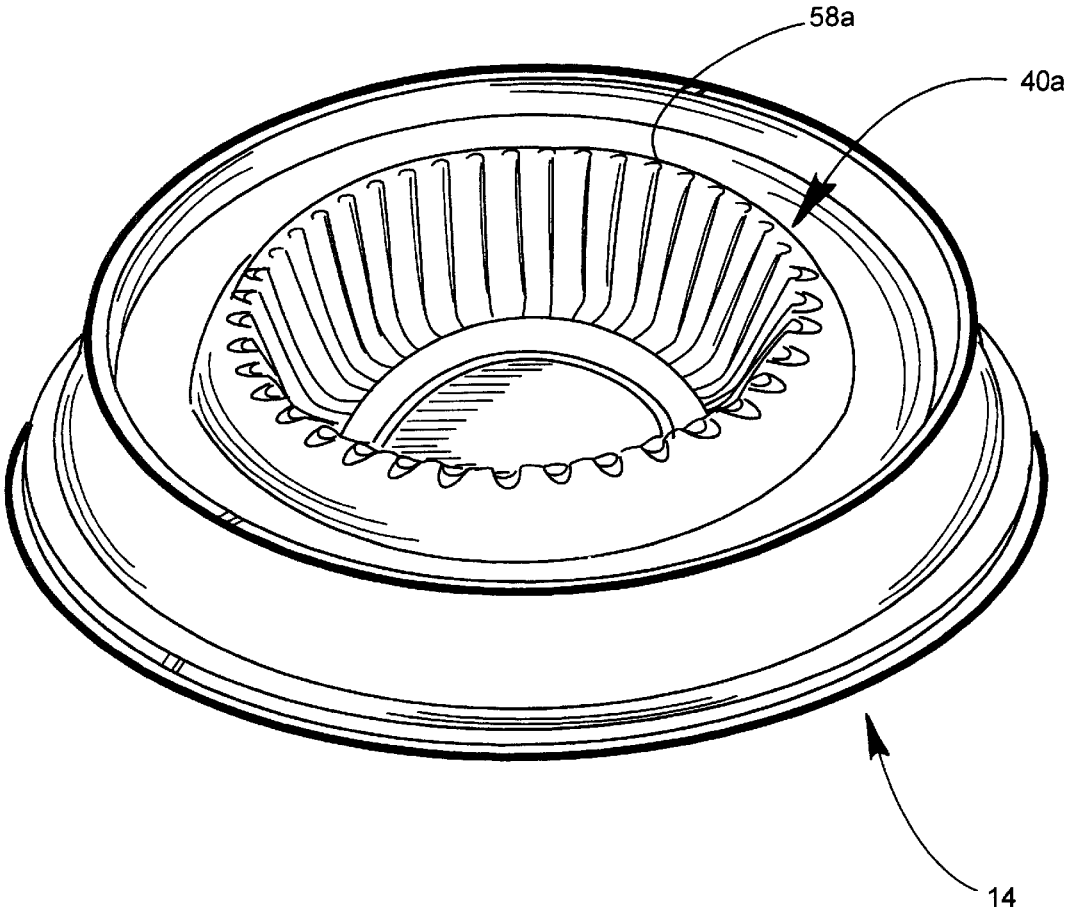
FIG. 6 is a perspective view of a base of a shrimp container according to another embodiment of the present invention.

The slots 58 aid in counting the shrimp and minimizing the side-to-side motion of the shrimp so as to maintain an evenly-spaced product appearance which is aesthetically pleasing to a customer. The number of slots 58, which assist the user in counting a specific number of shrimp, may vary within the well 40. For example, FIG. 2 illustrates a thirty (30) slot embodiment in which each slot 58 is capable of holding a single 41–50 count/lb. shrimp (not shown). In another embodiment, a similarly sized well as depicted in FIG. 2 may have a lesser number of slots, such as, twenty (20) or twenty-five (25) slots, which may hold the same sized shrimp as recited above (41–50 count/lb.) or a slightly larger size. It is also contemplated that the size of the well 40 may vary from that illustrated in FIG. 2. Such an embodiment is depicted in FIG. 6, for example, with the well 40*a* having forty (40) slots. Each slot 58*a* of the well 40*a* is capable of holding a single 41–50 count/lb. shrimp (not shown). Therefore, it is contemplated that the slots 58 may be designed to hold larger or smaller shrimp and various counts of shrimp.

Referring back to FIG. 2, a trough side wall 54 encompasses and extends downwardly and outwardly from an upper portion of the base side wall 52. The trough side wall 54 has a plurality of indicators 60 at a top edge thereof to assist individuals, such as employees, in counting the shrimp. As best depicted in FIG. 5, the plurality of indicators 60 are generally V-shaped or U-shaped as viewed from an exterior of the base 14. It is contemplated that other shapes may be used in forming the plurality of indicators 60.

The slots 58 are configured to facilitate the positioning of the shrimp as compared to existing smooth walled wells. The container 10 in FIG. 4 illustrates the installed shrimp 70 and a sauce receptacle 72. It is preferred that each of the slots 58 display and hold an individual shrimp, although it is contemplated that the slots 58 may be designed to hold a greater number of shrimp. The slots 58, as depicted in FIGS. 2 and 5, are concave as viewed from an interior of the well 40. The slots 58 preferably have a section extending outwardly from an interior of the well 40. However, the slots 58 may be configured to be a bracket-like shape (e.g., a "]" shape) as viewed from an interior of the well 40. It is contemplated that the slots 58 may be configured in any shape where each slot will display, transport and hold at least one shrimp 70.

To assist in storing liquids, such as shrimp purge, the base 14 includes the peripheral trough 62 as shown in FIG. 2. The peripheral trough 62 is defined by the trough side wall 54, a trough bottom wall 64 and an outer wall 66. The trough bottom wall 64 is preferably sloped downwardly and inwardly from the outer wall 66 towards the trough side wall 54. The sloped trough bottom wall 64 is best illustrated in FIGS. 3*a* and 4. Because the trough bottom wall 64 is sloped away from the cover and base closure mechanisms 30 and 42, respectively the possibility for any liquid escaping from the container 10 is reduced. Thus, the trough bottom wall 64 assists in maintaining a clean, aesthetically pleasing outer surface of the container 10. In addition, the sloping of the trough bottom wall 64 assists in preventing a head 70*a* of a shrimp from sitting in liquid, such as its own shrimp purges. The shrimp 70 in FIG. 4 extends upwardly from the bottom wall 50 to a position inward from the outer wall 66 and the cover and base closure mechanisms 30 and 42, respectively so as to inhibit shrimp purge from leaving the container 10.

The cover 12 and the base 14 are preferably formed from a polymer such as oriented polystyrene, polypropylenes, polyethylene terephthalates or any other thermoplastic materials using conventional thermoforming or injection molding processes. The thickness of the polymer may typically range from about 0.010 inch to about 0.250 inch, but is preferably from about 0.015 inch to about 0.040 inch. The base 14 may be opaque or may be a variety of colors or color combinations. However, the cover 12 is preferably transparent so that the customer can ascertain the nature of the accommodated product and the condition thereof without having to remove the cover 12.

The height and shape of the cover 12 and/or the base 14 may vary from that shown without departing from the scope of the invention. It is also contemplated that the shape and number of slots 58 formed in the well 40 may also vary from that shown without departing from the scope of the invention as discussed above.

While the present invention has been described with references to one or more particular embodiments, those skilled in the art will recognize that many changes may be made thereto without departing from the spirit and scope of the present invention. For example, the description of the preferred embodiments has focused solely on shrimp containers. In addition, the cover and base closure mechanisms 30 and 42, respectively may be respectively formed at different locations of the cover 12 and base 14. However, it is contemplated that the present invention may be applicable for transporting other food items that have similar problems as those discussed with respect to shrimp. Each of these embodiments and obvious variations thereof is contemplated as falling within the spirit and scope of the present invention, which is set forth in the following claims.

What is claimed is:

1. A base for displaying and holding shrimp, comprising:

a well having a bottom wall, and a base side wall, said bottom wall having a surface for holding a sauce receptacle, said base side wall encompassing and extending upwardly and outwardly from said bottom wall, said base side wall having a plurality of slots each for displaying and holding an individual shrimp, each slot having a section extending outwardly as viewed from an interior of said well; and a peripheral trough having a trough side wall, a trough bottom wall and an outer wall, said trough side wall encompassing and extending downwardly from an upper portion of said base side wall.

2. The base of claim 1 wherein said well is substantially circular.

3. The base of claim 1 wherein said bottom wall of said well is substantially circular, said bottom wall including a recessed central portion for holding said sauce receptacle.

4. The base of claim 1 wherein said trough side wall has a plurality of indicators extending from said respective slots to assist in counting said individual shrimp.

5. The base of claim 4 wherein said plurality of indictors are generally V-shaped as viewed from an exterior of said base.

6. The base of claim 1 wherein said trough bottom wall is sloped downwardly and inwardly from said outer wall towards said trough side wall.

7. The base of claim 1 wherein each of said slots is concave as viewed from an interior of said well.

8. A packed base, comprising:

a well having a bottom wall, and a base side wall, said bottom wall having a surface for holding a sauce receptacle, said base side wall encompassing and extending upwardly and outwardly from said bottom wall, said base side wall having a plurality of slots each having a section extending outwardly as viewed from an interior of said well;

a peripheral trough having a trough side wall encompassing and extending downwardly from an upper portion of said base side wall; and a plurality of shrimp each abutting and being held by a respective one of said plurality of slots, said plurality of shrimp extending upwardly from said bottom wall.

9. The packed base of claim 8 wherein said peripheral trough is defined by said trough side wall, an outer wall and a trough bottom wall.

10. The packed base of claim 9 wherein said trough bottom wall is sloped downwardly and inwardly from said outer wall towards said trough side wall.

11. The packed base of claim 8 wherein said trough side wall has a plurality of indicators extending from said respective slots to assist in counting said individual shrimp.

12. A packed container, comprising:

a base having a well, a peripheral trough and a base closure mechanism, said well having a bottom wall and a base side wall, said bottom wall having a surface for holding a sauce receptacle, said base side wall encompassing and extending upwardly and outwardly from said bottom wall, said peripheral trough having a trough side wall and an outer wall, said trough side wall encompassing and extending downwardly from an upper portion of said base side wall, said base closure mechanism including a generally horizontal first base ledge extending from said peripheral trough;

said base side wall has a plurality of slots each for holding a respective one of a plurality of shrimp, each slot having a section extending outwardly as viewed from an interior of said well;

said plurality of shrimp abutting said base side wall, said plurality of shrimp extending upwardly from said bottom wall;

a cover having a top wall, a cover side wall and a cover closure mechanism, said cover side wall encompassing and extending downward from said top wall; said cover being adapted to engage said base, said cover closure mechanism including a generally horizontal first cover ledge extending from said peripheral trough, said cover closure mechanism releasably engaging said base closure mechanism so as to inhibit shrimp purge from leaving said container; and said cover closure mechanism further including a generally horizontal second cover ledge and a generally vertical cover wall, said first cover ledge extending outwardly from and encompassing said first section, said cover wall encompassing said first cover ledge and extending downwardly and slightly inwardly therefrom, said second cover ledge encompassing said cover wall and extending outwardly therefrom until reaching said second section, said base closure mechanism further including a generally horizontal second base ledge and a generally vertical base wall, said base wall extending downwardly from and encompassing said first base ledge, said second base ledge extending outwardly from and encompassing said base wall.

13. The container of claim 12 wherein said peripheral trough is defined by said trough side wall, said outer wall and a trough bottom wall.

14. The container of claim 12 wherein said trough bottom wall is sloped downwardly and inwardly from said outer wall towards said cover side wall.

15. The container of claim 12 wherein said trough side wall has a plurality of indicators to assist in counting said individual shrimp.

16. The container of claim 12 wherein said base closure mechanism and said cover closure mechanism form a tortuous path when engaged.

17. The container of claim 12 wherein said cover closure mechanism further includes a drip ledge.

18. A container for displaying and holding shrimp, comprising:

a base having a well, a peripheral trough and a base closure mechanism, said well having a bottom wall and a base side wall, said bottom wall having a surface for holding a sauce receptacle, said base side wall encompassing and extending upwardly and outwardly from said bottom wall, said peripheral trough having a trough side wall and an outer wall, said base side wall for displaying and holding a plurality of shrimp, said trough side wall encompassing and extending downwardly from an upper portion of said base side wall, said base closure mechanism including a generally horizontal base ledge extending from said peripheral trough, said base side wall has a plurality of slots each for displaying and holding an individual shrimp, each slot having a section extending outwardly as viewed from an interior of said well; and a cover having a top wall, a cover side wall and a cover closure mechanism, said cover side wall encompassing and extending downward from said top wall, said cover being adapted to engage said base, said cover closure mechanism including a generally horizontal ledge extending from said peripheral trough, said cover closure mechanism releasably engaging said base closure mechanism so as to inhibit shrimp purge from leaving said container.

19. The container of claim 18 wherein said peripheral trough is defined by said second side wall, said outer wall and a trough bottom wall.

20. The container of claim 18 wherein said trough bottom wall is sloped downwardly and inwardly from said outer wall towards said second side wall.

21. The container of claim 18 wherein said cover closure mechanism further includes a drip ledge.

* * * * *